US005084696A

United States Patent [19]

Guscott et al.

[11] Patent Number: 5,084,696

[45] Date of Patent: Jan. 28, 1992

[54] SIGNAL DETECTION SYSTEM WITH DYNAMICALLY ADJUSTABLE DETECTION THRESHOLD

[75] Inventors: John K. Guscott; Gerard G. Stelmack, both of Hickory, N.C.

[73] Assignee: Aritech Corporation, Framingham, Mass.

[21] Appl. No.: 645,236

[22] Filed: Jan. 24, 1991

[51] Int. Cl.[5] ..... G08B 13/00

[52] U.S. Cl. ..... 340/541; 340/309.15; 340/526; 340/511

[58] Field of Search ..... 340/541, 529, 526, 522, 340/511, 309.15

[56] References Cited

U.S. PATENT DOCUMENTS

| | | | |
|---|---|---|---|
| 4,521,768 | 6/1985 | Haran et al. | 340/526 X |
| 4,528,553 | 7/1985 | Hastings et al. | 340/526 |
| 4,636,774 | 1/1987 | Galvin et al. | 340/541 X |
| 4,691,196 | 9/1987 | Kern et al. | 340/578 |
| 4,831,361 | 5/1989 | Kimura | 340/511 X |
| 4,975,684 | 12/1990 | Guttinger et al. | 340/522 X |

*Primary Examiner*—Glen R. Swann, III
*Assistant Examiner*—Thomas J. Mullen, Jr.
*Attorney, Agent, or Firm*—Weingarten, Schurgin, Gagnebin & Hayes

[57] ABSTRACT

A signal detection system with dynamically adjustable detection threshold includes a signal detection comparator having a dynamically adjustable threshold which adjusts the detection sensitivity of the comparator from a quiescent value to a value which is dependent upon the value of an event trigger signal, thus anticipating the amplitude of a second, confirming event trigger signal. Additionally, an alarm window timer activated by an event signal which exceeds the quiescent signal detection comparator threshold, assures that an alarm activator will be enabled only after a second, confirming event trigger signal exceeds the adjusted detector threshold, and which occurs during the active period of the alarm window timer.

11 Claims, 6 Drawing Sheets

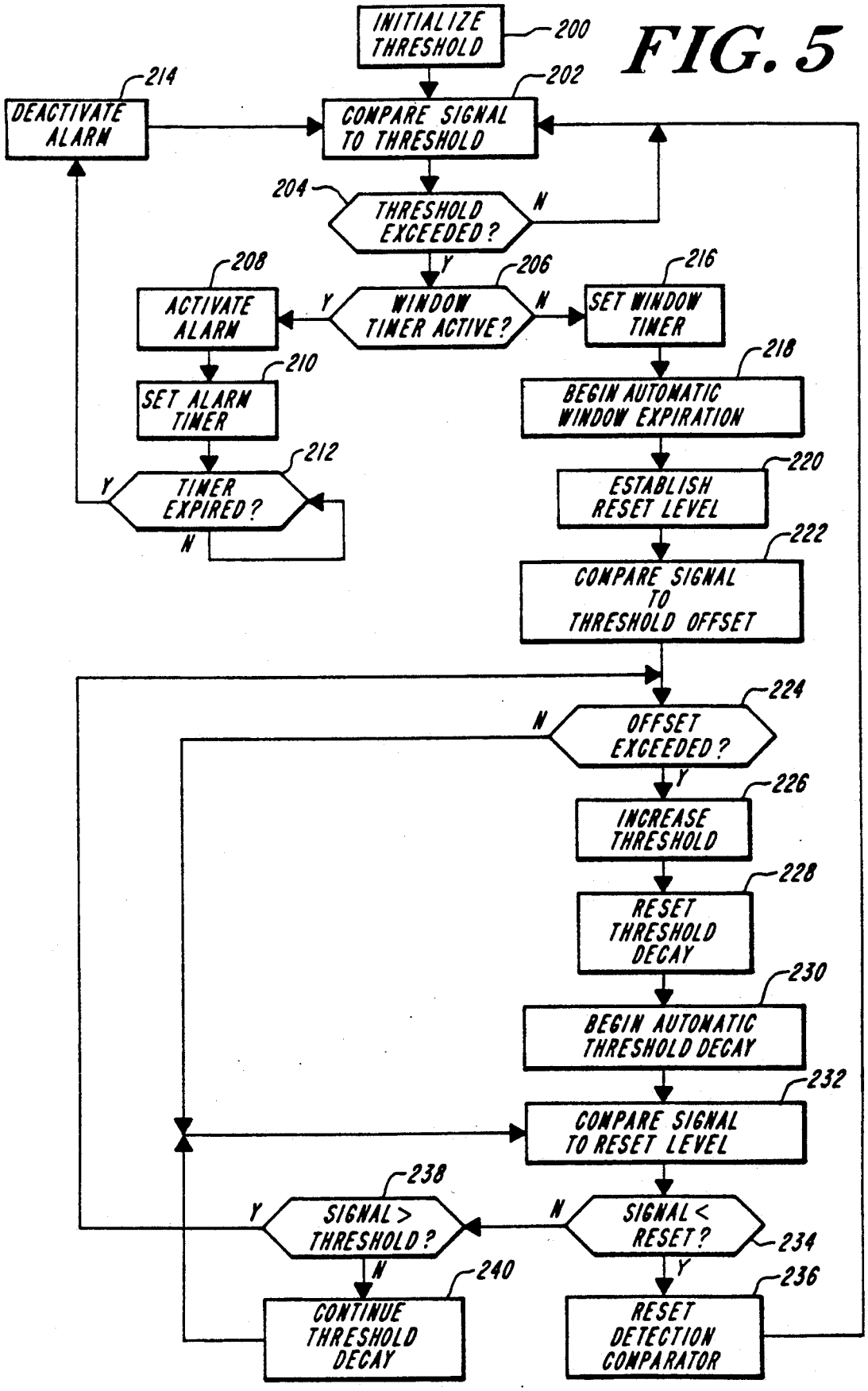
INITIALIZE THRESHOLD
200
FIG. 5
214
DEACTIVATE ALARM
202
COMPARE SIGNAL TO THRESHOLD
204
THRESHOLD EXCEEDED?
N
Y
208
ACTIVATE ALARM
Y
206
WINDOW TIMER ACTIVE?
N
216
SET WINDOW TIMER
210
SET ALARM TIMER
218
BEGIN AUTOMATIC WINDOW EXPIRATION
212
Y
TIMER EXPIRED?
N
220
ESTABLISH RESET LEVEL
222
COMPARE SIGNAL TO THRESHOLD OFFSET
224
N
OFFSET EXCEEDED?
Y
226
INCREASE THRESHOLD
228
RESET THRESHOLD DECAY
230
BEGIN AUTOMATIC THRESHOLD DECAY
232
COMPARE SIGNAL TO RESET LEVEL
238
Y
SIGNAL > THRESHOLD?
N
N
SIGNAL < RESET?
234
Y
240
CONTINUE THRESHOLD DECAY
236
RESET DETECTION COMPARATOR

SIGNAL DETECTION SYSTEM WITH DYNAMICALLY ADJUSTABLE DETECTION THRESHOLD

FIELD OF THE INVENTION

This invention relates to security systems and more particularly, to a detection system with a dynamically adjustable detection threshold.

BACKGROUND OF THE INVENTION

Security or condition sensors such as infrared detectors comprise one of the major components of detection systems. One problem with prior art detection systems, however, is the number of false alarms triggered by spurious stimuli unrelated to a legitimate event in the protected area. Among such stimuli that cause false triggering are cycling on and off of heaters within the field of view of the detector; visible and near infrared energy entering the detector field of view from high intensity light sources such as automobile headlights; mechanical shock and vibration; air drafts; and random internally generated spike noise produced by the detector.

Prior art detection systems have attempted to minimize or eliminate false alarm triggering by employing pulse counting or frequency discrimination methods. Although signals produced by the spurious stimuli have characteristic differences from the signals of legitimate events, simple pulse counting or frequency discrimination methods employed in the prior art have not proven completely effective for reasonably limiting or eliminating false alarm triggering while still retaining adequate detection of legitimate events.

The step response function of a conventional signal processing amplifier also contributes to the problems with prior art systems. Such an amplifier will produce a signal overshoot in response to unwanted stimuli. This signal overshoot causes two counts to be registered by conventional pulse counting circuitry in response to what was in reality only a single event. Accordingly, some systems have resorted to three count logic to avoid false alarm triggering. The use of three count logic, however, makes detection of a legitimate event by a single field of view detector more unlikely.

SUMMARY OF THE INVENTION

The present invention features a signal detection comparator with a dynamically adjustable threshold which adjusts the detection sensitivity of the signal detection comparator from a quiescent value to a value which is dependent upon the value of the event trigger signal, thus anticipating the amplitude of a second, confirming event signal. Additionally, an alarm window timer activated by an event signal which exceeds the signal detection comparator quiescent threshold, assures that an alarm activator will be enabled only by a second, confirming event signal which exceeds the dynamically adjusted detector threshold, and which occurs during the active period of the alarm window timer.

The signal detection system includes a signal detection comparator for comparing the value of an input signal with a dynamically adjustable threshold value having an initial value, and for providing a detection signal upon the input signal exceeding the initial value of the threshold. A threshold generator, responsive to the input signal and to a predetermined offset value, provides an adjusted threshold value to the comparator upon the input signal exceeding the predetermined offset value. The adjusted threshold value increases as a function of increases in value of the input signal, and decreases as a function of an RC time constant upon decreases in, or in the absence of the input signal.

The signal detection comparator with dynamically adjustable threshold according to the present invention may be utilized for event detection and confirmation in a system wherein the detection comparator provides a second confirming detection signal upon the input signal exceeding the value of the adjusted threshold value. Such a system also includes an event timer, responsive to a first detection signal from the comparator, for providing an alarm activation period signal during which an alarm signal may be generated. Also provided are one or more alarm activators, responsive to the alarm activation period signal and to a second, confirming event signal, for providing an alarm signal indicating an event has been detected and confirmed.

In one embodiment, the signal detection system receives an input signal from a sensor such as an infrared intrusion sensor. The input signal may be a bipolar signal wherein an absolute value amplifier is provided for converting the bipolar signal to a unipolar signal for further processing by the system. Further, the detection comparator also includes a reset level wherein the detection comparator disables the alarm timer and the alarm activator until the value of the input signal falls below the value of the reset level. Ideally, the reset level should be the zero crossing of the input signal in a bipolar circuit and the reversal of signal direction in embodiment employing the absolute value amplifier.

DESCRIPTION OF THE DRAWINGS

These and other features of the present invention will be better understood by reading the following detailed description, taken together with the drawings, wherein:

FIG. 5 is a flow chart detailing the operation of another embodiment the event detection system according to the present invention.

DETAILED DESCRIPTION OF THE INVENTION

Figure 1:
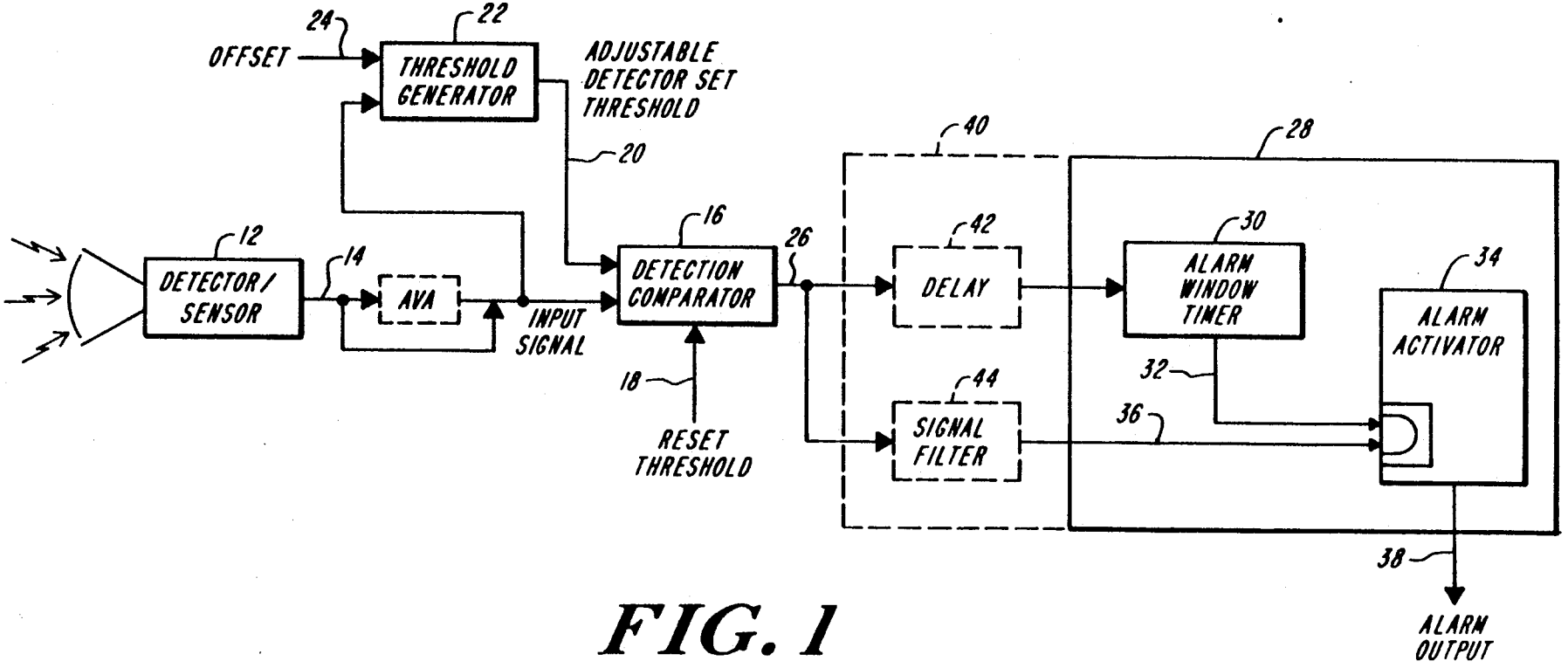
FIG. 1 is a block diagram of one embodiment the signal detection system with dynamically adjustable signal detection threshold according to the present invention.

The signal detection system with dynamically adjustable signal detection threshold according to the present invention is shown in FIG. 1 and includes a detector or sensor 12 which provides an event detection signal 14 in response to a detected event. Examples of detector 12 include infrared and other motion detectors, smoke detectors, and other alarm or condition sensors.

Dependent upon the polarity of event detection signal 14 and the remainder of the circuitry utilized to implement the system of the present invention, an optional absolute value amplifier 15 may be provided to convert a bipolar event detection detection signal 14 into a unipolar event detection signal 14*a*. For simplicity, the foregoing description will refer to signal 14, it being understood that signal 14*a* is also contemplated for those embodiments using amplifier 15. Detection comparator 16 compares event trigger signal 14 with a dynamically adjustable set threshold 20 having a predetermined initial value, and with a reset threshold value 18. The dynamically adjustable set threshold value 20 is provided by threshold generator 22 as a function of input signal 14 and a predetermined initial offset value 24. The threshold generator 22 adjusts the initial value of the dynamically adjustable set threshold 20 and provides an increased set threshold value as a function of increases in input signal 14. When the signal level decreases the set value decays as a function of the RC time constant.

Detection comparator 16 provides set and reset signals over signal path 26 through delay circuitry 42 and signal filter 44 to alarm timing logic 28. Alarm timing logic includes alarm window timer 30 which provides timing signal 32 enabling alarm activator 34 for a predetermined period of time. A second and subsequent confirming signal from detection comparator 16 provided over signal path 36 during the period of alarm window timer signal 32 activates alarm activator 34 and provides alarm output signal 38.

Figure 2:
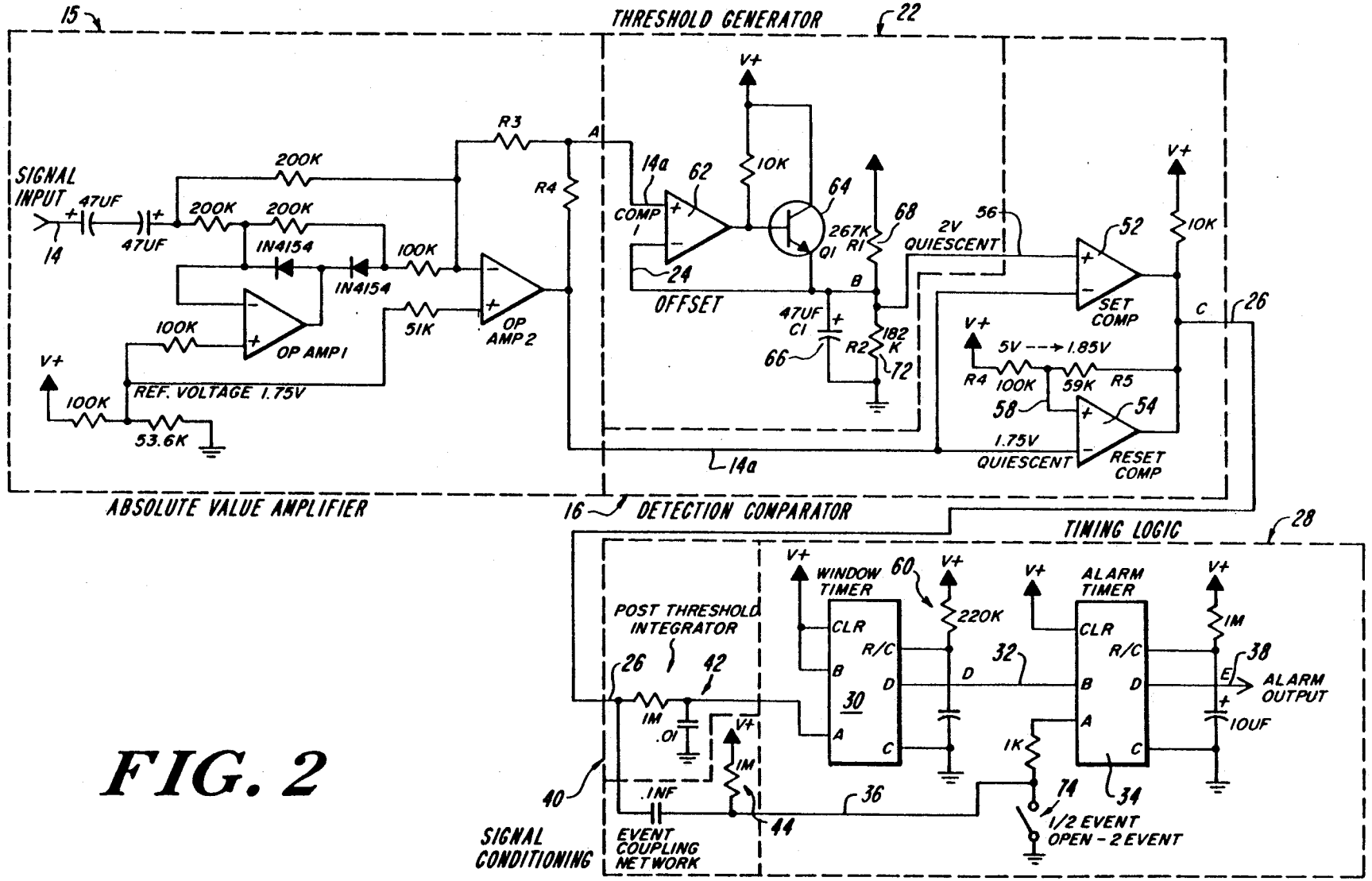
FIG. 2 is a schematic circuit diagram of one implementation of the signal detection system of the present invention.

One embodiment of the system of FIG. 1 is illustrated by the circuit of FIG. 2 wherein like parts are given like numbers. Absolute value amplifier 15 receives input signal 14 which is typically an amplified bipolar signal from one or more event detector. Absolute value amplifier 15 converts bipolar signal 14 to a unipolar or unidirectional signal 14*a*. In the present embodiment, unidirectional event trigger signal 14*a* is positive going and at a suitable DC reference potential for the following circuit stages. It should be noted, however, that absolute value amplifier 15 may also provide a negative going event trigger signal 14*a* provided that the following stages are suitably changed.

Detection comparator 16 is comprised of a set comparator 52 and a reset comparator 54. Set comparator 52 compares input trigger signal 14*a* with a dynamically adjustable set threshold signal 56 which has a predetermined, initial value. If event trigger signal 14*a* exceeds the predetermined initial set threshold signal value 56, set comparator 52 provides a negative going detection signal over signal path 26. The negative going detection signal is fed back to the positive input 58 of reset comparator 54. Thus, since the value on the positive input of reset comparator 54 is less than the input signal 14*a* on the negative input terminal of reset comparator 54, the reset comparator is also activated confirming a low output voltage on signal path 26. Additionally, the low output voltage on signal path 26 combined with resistors R4 and R5 establish the reset level of reset comparator 54. Input signal 14*a* must fall below the reset level before reset comparator 54 will provide a high output voltage, thereby resetting timing logic 28.

Output signal 26 from detection comparator 16 may be provided to signal conditioning unit 40 one embodiment of which includes an RC delay network 42 which serves to delay the operation of window timer 30 until after the output signal on signal path 26 reaches alarm activator timer 34. The delay insures that the first output signal from detection comparator 16 will only activate window timer 30 and not alarm activation timer 34. Signal filter 44 provides post detection comparator integration of the comparator output signal 26 so that very short duration pulses, not associated with a legitimate event, will not enable timing logic 28. Signal filter 44 processes, without delay, the output signal from detection comparator 16 and differentiates the signal so that its duration is unimportant to the circuit functionality.

Timing logic 28 provides output alarm signal 38 only upon a concurrence of alarm window timer signal 32 with the detection comparator output signal 36. Thus, since the detection comparator signal 36 will reach alarm activation timer 34 prior to the delayed window timer signal 32, the first set pulse from detection comparator 16 will not activate alarm activation timer 34. The first pulse will, however, activate window timer 30 to provide window timer signal 32 for a period of time which is determined by R/C network 60, which typically provides a 2 second activation period signal 32 to alarm activation timer 34.

If, however, a second and confirming event is detected by detection comparator 16 during the period that alarm window timer signal 32 is active, the concurrence of an event signal over signal path 36 with the alarm window timer signal 32 will enable alarm activation timer 34 and generate alarm output signal 38.

Threshold generator 22 is comprised of comparator 62 coupled to transistor 64 which charges capacitor 66. The charge on capacitor 66 cannot be below a minimum value which is determined by the voltage divider formed by resistors 68 and 72 labeled R1 and R2. This minimum voltage provided by the voltage divider forms the predetermined, initial offset value 24 to the threshold generator comparator 62. When the event trigger signal 14*a* exceeds the predetermined, initial offset value 24 which is typically approximately 2 volts, comparator 62 enables transistor 64. Additional voltage potential will then build up on capacitor 66 which will also be fed back to the negative input of comparator 62. This increase in charge potential will provide an increased threshold value on the positive input 56 provided to set comparator 52. The increased value will be a preselected percentage of the peak signal amplitude, which in this embodiment 70% as established by resistors R3 and R4 described below.

In order to cause an increase in the set threshold on positive input 56, event detection signal 14*a* must now exceed the new and slightly increased offset value 24 provided to comparator 62. Thus, increases in event signal 14*a* will cause a nearly immediate corresponding and proportional increase in the value of threshold signal 56 to comparator 52. The value of threshold signal 56 decays in the absence of, or in response to, the decreasing level of the input signal in accordance with the RC function of C1, R1 and R2 until the initial offset value is reached, at which point the threshold signal stabilizes.

The offset value 24 is established by the ratio of R1/R2 which sets the minimum value of detection threshold. Resistors R3/R4 in the feedback path of the absolute value amplifier 15 provide a means whereby the detection threshold may be "pushed" to a desired percentage of the output level without disturbing the DC value. This is an important consideration for event confirmation accuracy. Resistors R1 and R2 and capacitor C1 provide the "memory" for the adjusted threshold level, allowing the adjusted set threshold value to decay or decrease slowly.

Optional switch 74 may be provided to disable two-event timing, thus enabling alarm activation timer 34 to provide alarm output signal 38 upon detection of a first event which exceeds the threshold of detection comparator 16.

System event and detection signals produced by the circuitry of FIG. 2 are shown in FIGS. 3A–3E wherein timing signal letters correspond to the reference letters in the schematic block diagram of FIG. 2 to facilitate understanding of circuit operation. FIGS. 3A–3E further illustrate false alarm immunity provided by the system of the present invention. Accordingly, FIG. 3A includes output signal 100 from an absolute value amplifier (A) showing the absolute value amplifier going into saturation as a result of a heater turning on within the field of view of an infrared sensor.

Figure 3E:
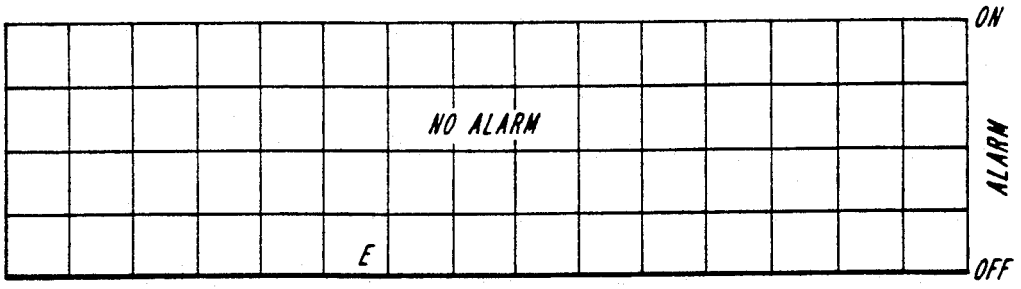
FIGS. 3A–3E are signal diagrams illustrating signal levels for an input signal, dynamically adjustable threshold, comparator, alarm activation timer and alarm signal, and showing the false alarm triggering immunity of the instant invention.
Figure 3D:
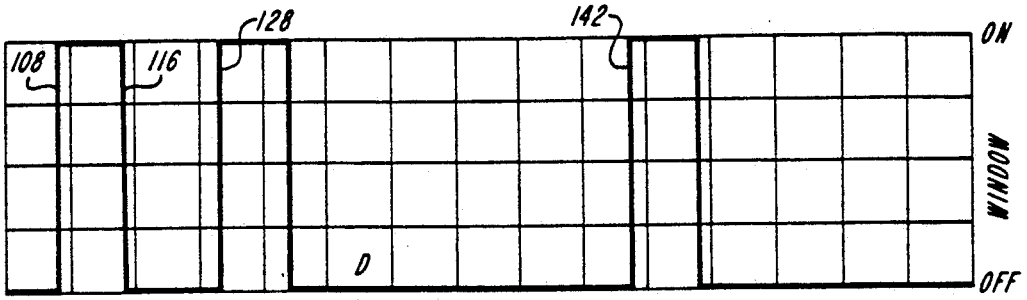
Figure 3C:
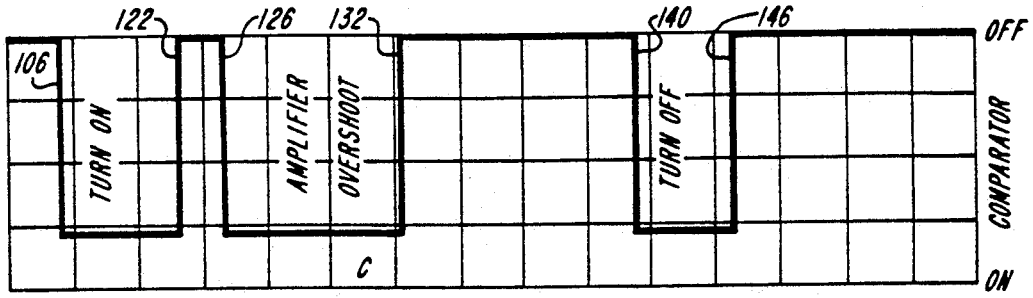
Figure 3B:
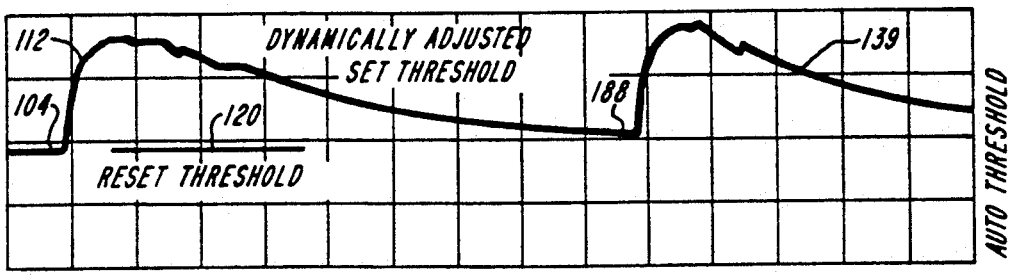

As shown at time period 102, the event trigger signal from the absolute value amplifier signal 100 crosses the predetermined initial offset value 104, FIG. 3B, causing detection comparator 16 to activate producing low going signal 106 (at C). Signal 106 from detection comparator 16 activates alarm window timer 30 producing window timer signal 108 (at D) FIG. 3D. Given that this is the first signal detected by the detection comparator, no alarm output signal (E) is provided as shown in FIG. 3E.

Figure 3A:
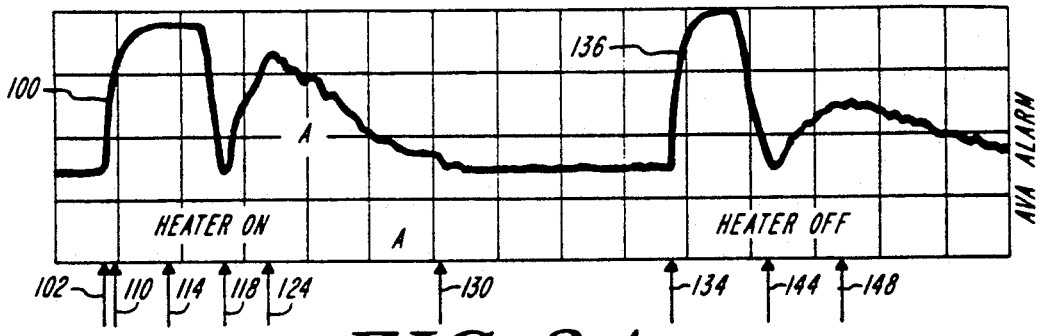

As shown at time period 110, however, output signal 100, FIG. 3A, from the absolute value amplifier 15, FIG. 2, exceeds the predetermined initial offset value of threshold generator 22 causing the threshold signal to increase 112, FIG. 3B with corresponding increases in input signal 100, FIG. 3A from the absolute value amplifier. At time period 114, alarm window timer 30 times out and becomes inactive as shown at 116, FIG. 3D.

After a given period of time as shown at time period 118, FIG. 3A, signal 100, FIG. 3A from the attached sensor/detector decreases below reset threshold 120 (at B), FIG. 3B thus resetting the detection comparator as shown at 122, FIG. 3C.

Subsequently, the absolute value amplifier then overshoots from its initial condition as shown at time period 124, FIG. 3A. Although the dynamically adjusted set threshold 112, (B) FIG. 3B of the detection comparator is slowly decaying, the overshoot is sufficient to exceed the decaying detection comparator threshold thus causing the detection comparator to again become activated as shown at 126, FIG. 3C. The activation of the detection comparator also causes alarm window timer to activate as shown at 128, FIG. 3D. However, since the alarm window timer had previously timed out at 116, this detectable event also does not set any alarm, FIG. 3E.

After a period of time as shown at time period 130, FIG. 3A, the sensor/detector signal from the absolute value amplifier falls below reset threshold 120, FIG. 3B causing the detection comparator to reset at 132 FIG. 3C. The dynamically adjustable set threshold of the detection comparator continues to decay until time period 134, FIG. 3A when turn off of the heater within the field of view of the detector/sensor provides signal 136 from the absolute value amplifier. Signal 136 from the absolute value amplifier exceeds threshold 138 of the detection comparator and causes the detection comparator to become enabled as shown at 140, FIG. 3C and also activates alarm window timer as shown at 142, FIG. 3D. Since the alarm window timer was not previously activated, no alarm is provided, FIG. 3E.

After an additional period of time as shown at time period 144, FIG. 3A, absolute value amplifier signal 136 falls below reset threshold 120 causing the detection comparator to reset at 146, FIG. 3C. A subsequent amplifier overshoot from the absolute value amplifier at 148 does not rise above the dynamically adjusted set threshold 139 of the detection comparator as shown at FIG. 3B and accordingly, the detection comparator is not triggered as shown at FIG. 3C. Accordingly, false alarm immunity has been provided to an event such as a heater turning on within the field of view of a sensor.

Figure 4F:
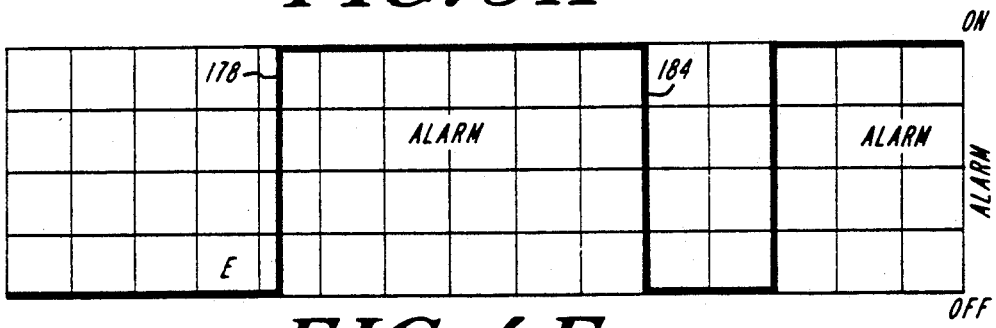
FIGS. 4A–4F are signal diagrams illustrating the system of the present invention responding to a legitimate stimulus.
Figure 4E:
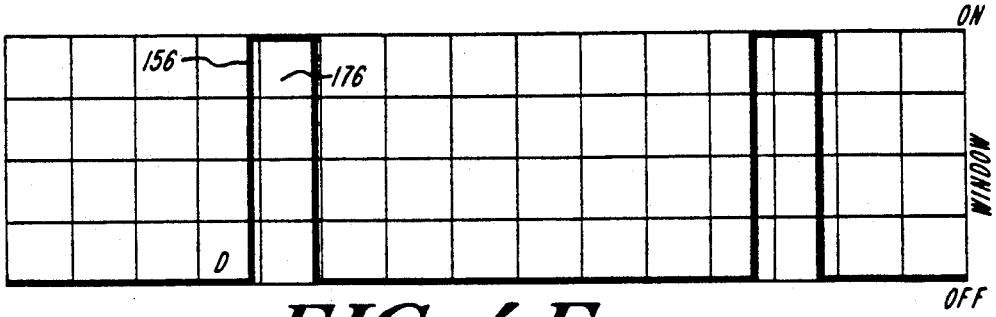
Figure 4D:
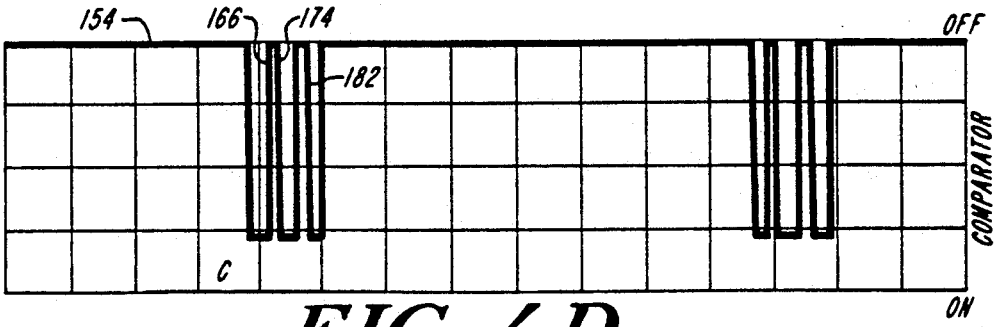
Figure 4C:
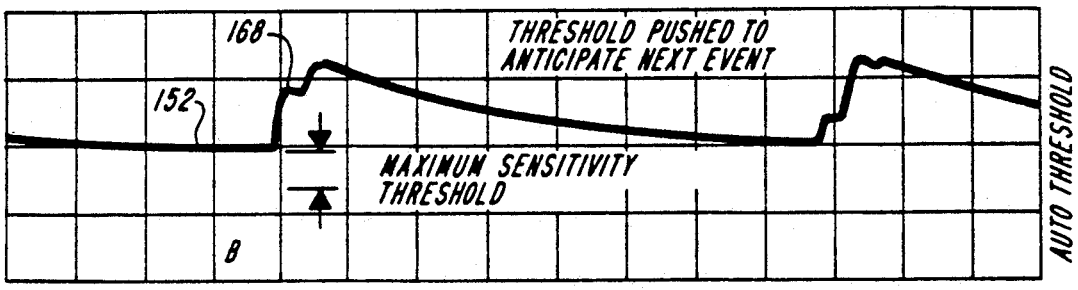
Figure 4B:
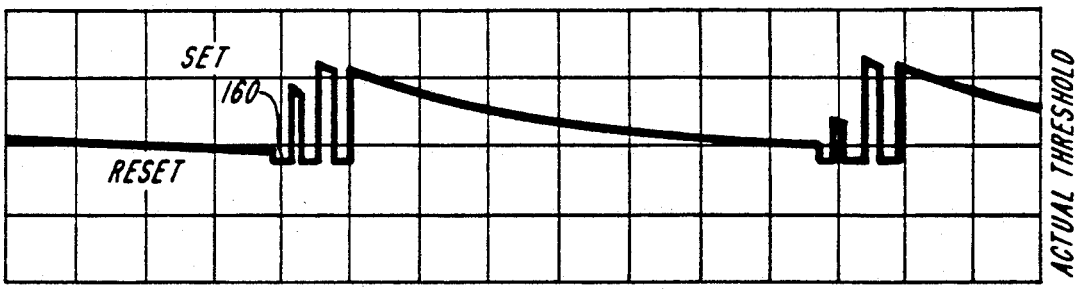
Figure 4A:
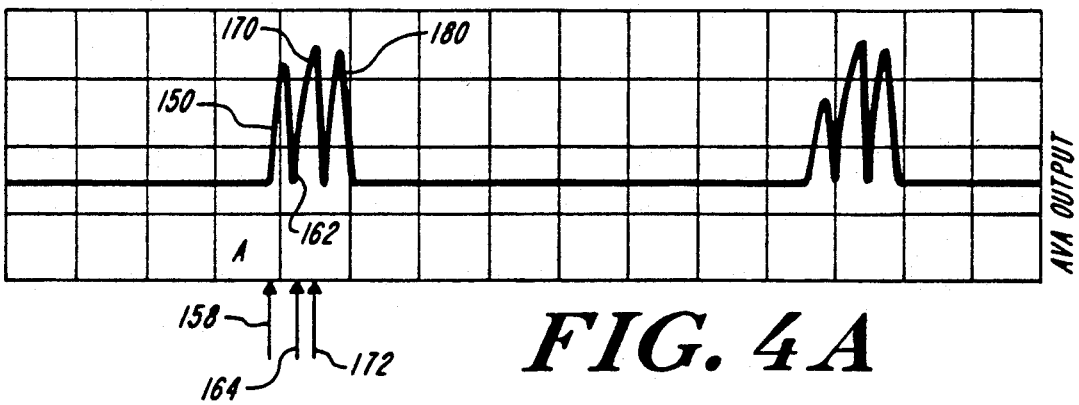

FIGS. 4A–4F illustrate the detection of a legitimate event which is confirmed during the period of time that the alarm window timer is active thus causing an alarm output signal to be generated. Reference letters are again utilized which correspond to the letters in the circuit diagram of FIG. 2. As shown in FIG. 4A, event pulse 150 crosses threshold 152, FIG. 4C of the detection comparator causing the output of the detection comparator to become active, as shown at 154, FIG. 4D and initiating the alarm window timer as shown at 156, FIG. 4E, at time step 158, FIG. 4A. The first trigger signal 150 also causes a corresponding rise in the detection comparator threshold 168, FIG. 4C. The enabling of the set comparator establishes the reset level of the reset comparator as shown at 160, FIG. 4B. As the event trigger signal 162 drops below reset level 160 at time period 164, the detection comparator resets as shown at 166, FIG. 4D.

A second trigger signal 170, FIG. 4A crosses detection comparator threshold 168 at approximately time period 172 causing the detection comparator output to become enabled as shown at 174, FIG. 4D. Since the second detection comparator activation at 174 has occurred during the active period 176, FIG. 4E, of the alarm window timer, an alarm signal 178, FIG. 4F is generated indicating that a legitimate event has been detected and confirmed by a second event trigger signal. Although a third trigger signal 180, FIG. 4A subsequently occurs which causes a corresponding detection comparator activation 182, FIG. 4D during the active period 176, FIG. 4E of the alarm window timer, this has no effect on alarm signal 178, FIG. 4F which continues until the R/C time constant of the alarm activation timer deactivates the alarm signal as shown at 184.

Although the present invention has previously been explained in conjunction with electronic circuitry, the signal detection system with dynamically adjustable detection threshold according to the present invention may be implemented utilizing software as shown in one embodiment by the flow chart at FIG. 5, wherein the system at step 200, initializes the detection threshold value. At step 202, the system compares an event signal with the detection threshold value. If the event signal does not exceed the threshold, step 204, system processing returns to step 202 wherein an event signal is again compared with the detection threshold.

If, at step 204, it is determined that the event signal exceeds the detection threshold, processing continues to step 206 wherein a determination is made as to whether or not an alarm window timer is active. If the alarm timer window was previously activated by an event signal, an alarm is triggered at step 208 which is utilized to alert the system user of the detected event. Upon alarm activation, an alarm timer is set at step 210, and processing proceeds to step 212, at which step the system waits for expiration of the alarm timer. When the alarm timer has expired, the system deactivates the alarm, step 214, and returns to step 202 where event signals are again compared with a detector threshold.

If the alarm window timer was not previously activated, step 206, processing continues to step 216 wherein the alarm window timer is set. The system then starts an automatic window expiration countdown at step 218. Step 220 establishes the reset level followed by a comparison of the event trigger signal to the threshold offset at step 222.

If, at step 224, it is determined that the threshold offset has been exceeded by the event signal, the threshold level is increased at step 226. At this point the system resets the threshold decay period, step 228, and begins an automatic threshold decay at step 230. If at step 224, the threshold offset level is not exceeded by the event signal, the system proceeds directly to step 232 wherein the event signal is compared to the reset level established at step 220.

Following the comparison of the event signal to the reset level at step 232, an inquiry is made as to whether the event signal exceeds the reset value, step 234. If the event signal has a value which is greater than the value of the reset level, the event signal is then compared to the threshold level, step 238. If the event signal value is greater than the threshold signal value, the system returns to step 224 to evaluate whether the offset level has been exceeded.

If, however, the event signal level is less than the threshold level, step 238, the system proceeds to step 240 which allows the threshold level to continue to decay. Processing then returns to step 232 for comparison of the event signal to the reset level.

If, at step 234, it is determined that the event trigger signal value is less than the value of the reset threshold, the system continues to step 236 wherein the detection comparator output is reset and processing returns to step 202 for comparison of an event trigger signal with the detection comparator threshold.

Modifications and substitutions by one of ordinary skill in the art are considered to be within the scope of the present invention, which is not to be limited except by the claims which follow.

We claim:

1. A system for dynamically adjusting the threshold of a signal detection comparator as a function of an input trigger signal, comprising:

means for receiving an input signal having a value;

comparator means, for comparing the value of said input signal with a dynamically adjustable threshold value having a predetermined initial value, and for providing a detection signal upon the value of said input signal exceeding the value of said threshold; and threshold generator means, responsive to said input signal and to a predetermined offset value, for dynamically adjusting the initial value of said dynamically adjustable threshold, and for providing an adjusted threshold value to said comparator means upon the value of said input signal exceeding said predetermined offset value, said adjusted threshold value increasing as a function of increases in value of said input signal, and decreasing as a function of a predetermined selectable period of time.

2. A system for detecting and confirming the occurrence of a trigger signal, including a dynamically adjustable signal detection comparator threshold, comprising:

means for receiving an input signal having a variable value;

comparator means, for comparing the value of said input signal with a dynamically adjustable threshold value having a predetermined initial value, and for providing a first detection signal upon said input signal exceeding the initial value of said adjustable threshold;

threshold generator means, responsive to said input signal and to a predetermined offset value, for adjusting the initial value of said adjustable threshold, and for providing an adjusted threshold value to said comparator means upon said input signal exceeding said predetermined offset value, said adjusted threshold value increasing as a function of increases in value of said input signal, and decreasing as a function of a predetermined selectable period of time; and said comparator means providing a second, confirming detection signal upon said input signal exceeding the value of said adjusted threshold value.

3. An event detection and confirmation system, including a signal detector having a signal detection threshold which is dynamically adjustable as a function of an event signal, comprising:

at least one sensor, for providing an event signal having a variable value representative of the detection of an event;

at least one comparator, for comparing the value of said event signal with a dynamically adjustable threshold value having a predetermined initial value, and for providing a first detection signal upon the value of said event signal exceeding the initial value of said threshold;

a threshold generator, responsive to said event signal and lo a predetermined offset value, for dynamically adjusting said dynamically adjustable threshold value upon said event signal exceeding said predetermined offset value, said threshold generator increasing said adjustable threshold value as a function of increases in said event signal, and decreasing said adjustable threshold value as a function of a predetermined selectable period of time;

said at least one comparator providing a second confirming detection signal upon the value of said event signal exceeding the value of said adjusted threshold value;

at least one alarm timer, responsive to said first detection signal from said at least one comparator, for providing an alarm activation period signal during which an alarm signal may be generated; and an alarm activator, responsive to said alarm activation period signal and to said second confirming detection signal, for providing an alarm signal indicating an event has been detected and confirmed.

4. The system of claim 3 wherein said event signal is a bipolar signal.

5. The system of claim 4 further including an absolute value amplifier, responsive to said event signal, for converting said bipolar event signal into a unipolar event signal.

6. The system of claim 3 wherein said at least one comparator further includes a reset signal value, operative for disabling said at least one alarm timer and said at least one alarm activator upon the value of said event signal decreasing below the value of said reset signal value.

7. The system of claim 6 wherein said reset signal value is operative upon said event signal exceeding the initial value of said threshold.

8. The system of claim 3 wherein said predetermined selectable period of time is established by an R/C time constant.

9. The system of claim 3 wherein said adjusted threshold value decreases as a function of a predetermined selectable period of time in conjunction with the absence of said event signal.

10. The system of claim 3 wherein said adjusted threshold value decreases as a function of a predetermined selectable period of time in conjunction with decreases in value of said event signal.

11. An intrusion detection system, including an intrusion detector having a detection threshold which is dynamically adjustable as a function of an intrusion detection signal, comprising:

at least one intrusion detector, for providing a variable value intrusion detection signal representative of the detection of an intrusion;

at least one comparator, for comparing the value of said intrusion detection signal with a dynamically adjustable threshold value having a predetermined initial value, and for providing a first signal upon the value of said intrusion detection signal exceeding the initial value of said threshold;

at least one threshold generator, responsive to said intrusion detection signal and to a predetermined offset value, for dynamically adjusting said adjustable threshold value upon the value of said intrusion detection signal exceeding said predetermined offset value, said at least one threshold generator increasing said adjustable threshold value as a function of increases in said intrusion detection signal, and decreasing said adjustable threshold value as a function of a predetermined selectable period of time;

said at least one comparator providing a second confirming detection signal upon the value of said intrusion detection signal exceeding the value of said dynamically adjustable threshold value;

at least one alarm timer, responsive to said first detection signal from said at least one comparator, for providing an alarm activation period signal during which an alarm signal may be generated; and at least one alarm activator, responsive to said alarm activation period signal and to said second confirming detection signal, for providing an alarm signal indicating an intrusion has been detected and confirmed.

* * * * *